US007203450B2

(12) United States Patent
Kakegawa et al.

(10) Patent No.: US 7,203,450 B2
(45) Date of Patent: Apr. 10, 2007

(54) DEVELOPING ROLLER, DEVELOPING APPARATUS, PROCESS CARTRIDGE, AND IMAGE FORMATION APPARATUS

(75) Inventors: Mieko Kakegawa, Kanagawa (JP); Sumio Kamoi, Tokyo (JP); Kyohta Koetsuka, Kanagawa (JP); Noriyuki Kamiya, Kanagawa (JP); Tsuyoshi Imamura, Kanagawa (JP)

(73) Assignee: Ricoh Company, Ltd, Tokyo (JP)

( * ) Notice: Subject to any disclaimer, the term of this patent is extended or adjusted under 35 U.S.C. 154(b) by 163 days.

(21) Appl. No.: 10/998,547

(22) Filed: Nov. 30, 2004

(65) Prior Publication Data

US 2005/0135843 A1 Jun. 23, 2005

(30) Foreign Application Priority Data

Dec. 1, 2003 (JP) ..... 2003-401577
Sep. 22, 2004 (JP) ..... 2004-274933

(51) Int. Cl.
*G03G 15/09* (2006.01)

(52) U.S. Cl. ..... 399/277

(58) Field of Classification Search ..... 399/267, 399/276, 277

See application file for complete search history.

(56) References Cited

U.S. PATENT DOCUMENTS 5,244,741 A 9/1993 Nagano et al.
6,070,038 A 5/2000 Imamura et al.
6,112,042 A 8/2000 Imamura et al.
6,125,255 A * 9/2000 Litman et al. ..... 399/277
6,198,895 B1 3/2001 Tsuda et al.
6,287,246 B1 9/2001 Yoshii et al.
6,330,415 B1 12/2001 Imamura et al.
6,337,957 B1 1/2002 Tamaki et al.
6,442,364 B2 8/2002 Kai et al.
6,456,806 B2 9/2002 Shoji et al.
6,522,855 B1 2/2003 Katoh et al.
6,597,885 B2 7/2003 Kai et al.
6,697,593 B2 2/2004 Imamura et al.
6,757,509 B2 6/2004 Shoji et al.
6,757,511 B2 6/2004 Sugimoto et al.

(Continued)

FOREIGN PATENT DOCUMENTS

JP 2001-296743 10/2001

(Continued)

*Primary Examiner*—Sandra L. Brase
(74) *Attorney, Agent, or Firm*—Oblon, Spivak, McClelland, Maier & Neustadt, P.C.

(57) ABSTRACT

A developing roller includes a developing sleeve having a nonmagnetic material, and a magnet roll provided inside the developing sleeve and formed by dispersing a magnetic powder in a polymer compound. A portion of the magnet roll corresponding to a developing pole of the magnet roll is equipped with a main-pole molded magnet whose magnetic force per unit of volume is greater than that of the magnet roll. A magnetic pole adjacent to the developing pole of the magnet roll downstream in the developer conveyance direction has a peak magnetic flux density on the developing sleeve greater than that of the developing pole, and has a half value width, which is the width of the magnetic pole at which a magnetic flux density of one-half the peak magnetic flux density is exhibited, greater than that of the developing pole.

16 Claims, 11 Drawing Sheets

U.S. PATENT DOCUMENTS

| | | | | |
|---|---|---|---|---|
| 6,778,805 | B2 | 8/2004 | Kai et al. | |
| 6,823,163 | B2 | 11/2004 | Sugimoto et al. | |
| 2002/0114647 | A1* | 8/2002 | Imamura et al. | 399/267 |
| 2003/0039487 | A1* | 2/2003 | Ikeguchi | 399/277 |
| 2003/0152403 | A1* | 8/2003 | Suzuki et al. | 399/267 |
| 2004/0018031 | A1 | 1/2004 | Imamura et al. | |
| 2004/0113118 | A1 | 6/2004 | Kamoi et al. | |

FOREIGN PATENT DOCUMENTS

| | | | |
|---|---|---|---|
| JP | 2003-270951 | * | 9/2003 |
| JP | 2004-46090 | | 2/2004 |
| JP | 2004-70045 | | 3/2004 |
| JP | 2004-240109 | | 8/2004 |

* cited by examiner

FIG. 14

| | | MOLD | | | | COMPLETED ARTICLE | | | |
|---|---|---|---|---|---|---|---|---|---|
| | | WIDTH (mm) | HEIGHT (mm) | LENGTH (mm) | SHAPE | WIDTH (mm) | HEIGHT (mm) | LENGTH (mm) | SHAPE |
| P1-USE | | 2.27 | 4.0 | 306.0 | Fig. 10 | 2.31 | 2.03 | 306.1 | Fig. 4C |
| P2-USE | SPECIFIC EX. ① | 2.27 | 12.0 | 306.0 | Fig. 10 | 2.31 | 6.05 | 306.1 | Fig. 4C |
| | SPECIFIC EX. ② | 2.27 | 12.0 | 306.0 | – | 2.31 | 6.04 | 306.1 | Fig. 7A |
| | SPECIFIC EX. ③ | 2.27+1 | 12+8 | 306.0 | Fig. 13 | 2.31+1.05 | 10.08 | 306.0 | Fig. 8A |
| | COMP. EX. 2 | INJECTION MOLDING | | | | 1.8 | 6.5 | 306 | CUBOID |

FIG. 15

| | P2 MOLDED ARTICLE | P1 POLE | | P2 POLE | | HALF VALUE WIDTH RATIO | N POLE : S POLE | CARRIER ADHESION EVALUATION RESULT |
|---|---|---|---|---|---|---|---|---|
| | | MAGNETIC FLUX DENSITY (mT) | HALF VALUE WIDTH (Deg) | MAGNETIC FLUX DENSITY (mT) | HALF VALUE WIDTH (Deg) | | | |
| SPECIFIC EX. 1 | SPECIFIC EX. ① | 115.2 | 21.6 | 122.5 | 28.6 | 1.32 | 1.0 : 1.1 | ○ |
| SPECIFIC EX. 2 | SPECIFIC EX. ② | 114.8 | 21.9 | 122.8 | 29.5 | 1.35 | 1.0 : 1.08 | ◎ |
| SPECIFIC EX. 3 | SPECIFIC EX. ③ | 115.0 | 21.8 | 122.4 | 28.6 | 1.31 | 1.0 : 1.13 | ◎ |
| SPECIFIC EX. 4 | SPECIFIC EX. ④ | 121.4 | 24.0 | 122.7 | 29.4 | 1.23 | 1.0 : 1.12 | ○ |
| COMP. EX. 1 | NONE | 115.4 | 21.5 | 53.8 | 43.6 | 2.03 | 1.0 : 0.9 | × |
| COMP. EX. 2 | COMP. EX. 2 | 116.5 | 22.0 | 99.5 | 31.0 | 1.41 | 1.0 : 1.04 | × |
| COMP. EX. 3 | P1 MAG | 121.0 | 23.5 | 121.5 | 23.2 | 0.99 | 1.0 : 1.01 | × |

◎: FIVE OR FEWER PER 10 $cm^2$, ○: SIX TO SEVEN PER 10 $cm^2$, △: EIGHT TO TEN PER 10 $cm^2$,
×: MORE THAN TEN PER 10 $cm^2$

DEVELOPING ROLLER, DEVELOPING APPARATUS, PROCESS CARTRIDGE, AND IMAGE FORMATION APPARATUS

BACKGROUND OF THE INVENTION

1. Field of the Invention

The present invention relates to a developing apparatus, to a developing apparatus in which the developing roller is used, and to a process cartridge and an image formation apparatus equipped with the developing apparatus.

2. Description of the Related Art

With an electrophotographic image formation apparatus such as a copier, laser printer, or fax machine, or a multipurpose machine combining two or more of these functions, an electrostatic latent image formed on a latent image support such as a photosensitive drum or photosensitive belt is developed by a developing apparatus to produce a visible image. A so-called two-component developing system, featuring a developer obtained by mixing a nonmagnetic toner with a magnetic carrier, is well known and has been widely used in such developing apparatus in recent years.

With this two-component developing system, the developer is magnetically held to the outer peripheral surface of a developing roller to form a magnetic brush, and an electrostatic latent image is developed in a developing region where there is an electrical field sufficient for developing between the developing roller and the latent image support, by selectively supplying toner and causing it to adhere to the latent image on the latent image support across from the magnetic brush by means of the electrical field formed between the latent image support on which the electrostatic latent image has been formed and a sleeve to which an electrical bias has been applied.

A developing roller is generally equipped with a cylindrical developing sleeve composed of a nonmagnetic material, and a magnet roll is provided inside this sleeve so as to form a magnetic field that will cause the developer to rise in the form of a magnetic brush on the rear surface of the sleeve. With a developing roller such as this, the carrier rises on the sleeve along the magnetic lines of force issuing from the magnet roll, and charged toner is deposited on the resulting carrier. The magnet roll has a plurality of magnetic poles formed from magnets or the like, and is equipped with a developing pole for raising the developer, particularly in the developing region portion of the sleeve surface. When the developing sleeve and/or the magnet roll moves, the developer that has risen in the form of a magnetic brush on the sleeve surface also moves, the developer conveyed to the developing region is raised up along the magnetic lines of force issuing from the developing main pole, forming brush chains, these developer chains bend while coming into contact with the latent image support surface, and toner is supplied while the brush chains rub against the electrostatic latent image on the basis of a difference in relative linear velocity versus the latent image support.

With a conventional two-component developing type of developing apparatus, the developing conditions for raising image density are incompatible with the developing conditions for obtaining an image with good contrast, making it difficult to improve both a high density portion and a low density portion at the same time. Examples of developing conditions for raising image density include narrowing the developing gap (the gap between the latent image support and the developing sleeve), and broadening the developing region in width. Meanwhile, examples of developing conditions for obtaining an image with good contrast include widening the developing gap, and narrowing the developing region width. In other words, these two developing conditions are contradictory, and it is generally difficult to obtain a good-quality image by satisfying both conditions over the entire image density range.

For instance, when the emphasis is on obtaining a low-contrast image, the trailing edge of a black solid image or a halftone solid image tends to be lost, which also occurs with the crossing portions of solid lines.

Raising the magnetic flux density of the developing pole and narrowing the half value width is an effective way to reduce this trailing edge loss. Various constitutions in which a molded magnet with high magnetic characteristics is disposed at a location corresponding to the developing pole of a magnet roll have been proposed in the past in an effort to achieve high magnetic flux density and narrow half value width, one of which is disclosed in Japanese Laid-Open Patent Application 2001-296743, for example.

With the image formation apparatus of recent years, however, there has been a trend toward reducing the particle size of the developer carrier because of the need for higher image quality. Nevertheless, when the particle size of the carrier is reduced, there is less margin for carrier deposition on the latent image support with the developing roller discussed in the above-mentioned publication, and the carrier tends to be deposited along with the toner on the latent image support. "Carrier deposition" refers to a phenomenon whereby the carrier which is supposed to accumulate on the developing roller is deposited on the latent image support along with the toner in the course of the developer being conveyed for developing to the latent image support by the magnetic force of the developing roller. This is a product of the balance between the electrical force from the latent image support and the magnetic force from the developing roller acting on the carrier. If the electrical force is strong, the carrier will be deposited on the latent image support. The deposited carrier is transferred and fixed along with the toner on the paper, which has an adverse effect on the transfer apparatus and fixing apparatus, and is a cause of lower reliability of an image formation apparatus. In order to prevent carrier deposition, the charge potential of the latent image support or the potential of the developing roller is sometimes adjusted so as to reduce the electrical force to which the carrier is subjected, but this tends to result in image problems such as greasing.

SUMMARY OF THE INVENTION

It is an object of the present invention to provide a developing roller, developing apparatus, process cartridge, and image formation apparatus with which the above problems encountered in the past can be solved, greasing and so forth can be prevented, and carrier deposition can be reduced.

In accordance with the present invention, there is provided a developing roller, comprising a developing sleeve consisting of a nonmagnetic material, and a magnet roll provided inside the developing sleeve and formed by dispersing a magnetic powder in a polymer compound, the portion corresponding to the developing pole of the magnet roll being equipped with a main-pole molded magnet whose magnetic force per unit of volume is greater than that of the magnet roll, wherein the magnetic pole adjacent to the developing pole of the magnet roll downstream in the developer conveyance direction has a peak magnetic flux density on the developing sleeve equal to or greater than that of the developing pole, and has a half value width, which is the width of the magnetic pole at which a magnetic flux density of one-half the peak magnetic flux density is exhibited, is greater than that of the developing pole.

The present invention further provides a developing apparatus equipped with a developing roller for developing an electrostatic latent image formed on a latent image support, the developing roller comprising a developing sleeve consisting of a nonmagnetic material, and a magnet roll provided inside the developing sleeve and formed by dispersing a magnetic powder in a polymer compound, the portion corresponding to the developing pole of the magnet roll being equipped with a main-pole molded magnet whose magnetic force per unit of volume is greater than that of the magnet roll, wherein the magnetic pole adjacent to the developing pole of the magnet roll downstream in the developer conveyance direction has a peak magnetic flux density on the developing sleeve equal to or greater than that of the developing pole, and has a half value width, which is the width of the magnetic pole at which a magnetic flux density of one-half the peak magnetic flux density is exhibited, is greater than that of the developing pole.

The present invention further provides a process cartridge equipped with a developing apparatus, the developing apparatus being equipped with a developing roller for developing an electrostatic latent image formed on a latent image support, the developing roller comprising a developing sleeve consisting of a nonmagnetic material, and a magnet roll provided inside the developing sleeve and formed by dispersing a magnetic powder in a polymer compound, the portion corresponding to the developing pole of the magnet roll being equipped with a main-pole molded magnet whose magnetic force per unit of volume is greater than that of the magnet roll, wherein the magnetic pole adjacent to the developing pole of the magnet roll downstream in the developer conveyance direction has a peak magnetic flux density on the developing sleeve equal to or greater than that of the developing pole, and has a half value width, which is the width of the magnetic pole at which a magnetic flux density of one-half the peak magnetic flux density is exhibited, is greater than that of the developing pole.

The present invention further provides an image formation apparatus equipped with a developing apparatus, the developing apparatus being equipped with a developing roller for developing an electrostatic latent image formed on a latent image support, the developing roller comprising a developing sleeve consisting of a nonmagnetic material, and a magnet roll provided inside the developing sleeve and formed by dispersing a magnetic powder in a polymer compound, the portion corresponding to the developing pole of the magnet roll being equipped with a main-pole molded magnet whose magnetic force per unit of volume is greater than that of the magnet roll, wherein the magnetic pole adjacent to the developing pole of the magnet roll downstream in the developer conveyance direction has a peak magnetic flux density on the developing sleeve equal to or greater than that of the developing pole, and has a half value width, which is the width of the magnetic pole at which a magnetic flux density of one-half the peak magnetic flux density is exhibited, is greater than that of the developing pole.

BRIEF DESCRIPTION OF THE DRAWINGS

The above and other objects, features, and advantages of the present invention will become more apparent from the following detailed description taken with the accompanying drawings, in which:

FIG. 14 is a table of the properties of the mold and completed article of the molded magnet; and FIG. 15 is a table of the results of evaluating the magnetic characteristics of the magnet roll and the carrier deposition margin.

DESCRIPTION OF THE PREFERRED EMBODIMENTS

Embodiments of the present invention will now be described through reference to the appended drawings.

Figure 1:
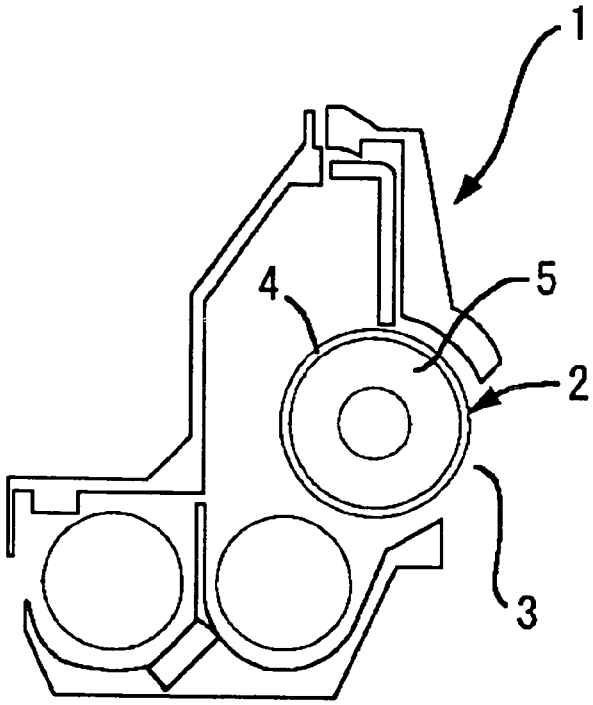
FIG. 1 is a simplified structural diagram illustrating the main components of the developing apparatus pertaining to the present invention.

In FIG. 1, a developing roller 2 is provided to a developing apparatus 1, and the developing roller 2 is disposed across from a photosensitive drum (latent image support; not shown) via an opening 3 formed in the developing apparatus casing. The developing roller 2 is constituted by a developing sleeve 4, which comprises aluminum, brass, stainless steel, a conductive resin, or another such nonmagnetic material formed into a cylindrical shape, and a magnet roll 5 provided inside this developing sleeve 4. The developing sleeve 4 is rotated clockwise in the drawing by a drive means (not shown), while the magnet roll 5 is in a fixed state.

The magnet roll 5 has a diameter of approximately 23 mm, is composed of a rubber magnet or plastic magnet obtained by dispersing a magnetic powder in a polymer compound, and can be obtained by extrusion molding, for example. Specifically, a magnetic field is applied within the mold during molding to achieve an anisotropic state, after which the mold is demagnetized, a core is inserted and yoke magnetization is performed to obtain a magnet roll 5 with the desired magnetic characteristics. The developing roller 2 is obtained by installing this magnet roll 5 inside the developing sleeve 4.

A developing roller 2 capable of reducing trailing edge loss needs to have a developing pole P1 (shown in FIG. 2) in which the peak magnetic flux density on the sleeve is high and the region thereof is narrow. For instance, trailing edge loss can be reduced if the peak magnetic flux density is at least 100 mT and the half value width is 250 or lower. However, a magnetic pole with high magnetic force at such a narrow width cannot be obtained from the above-mentioned plastic magnet. In view of this, as shown in FIG. 2, a groove 6 is provided at a location in the magnet roll 5 corresponding to the developing pole P1, and a molded magnet 7 is installed as a main-pole molded magnet with high magnetic characteristics in this groove 6 by adhesive bonding or the like.

The material of the magnet roll 5 is most often a plastic magnet or rubber magnet obtained by mixing a magnetic powder of strontium ferrite or barium ferrite with a polymer compound such as a PA (polyamide) based material such as 6PA or 12PA, an ethylene compound such as EEA (ethylene/ethyl [acrylate] copolymer) or EVA (ethylene/vinyl [acetate] copolymer), a chlorine based material such as CPE (chlorinated polyethylene), or a rubber material such as NBR.

Also, the molded magnet 7 is a rod-like block extending in the developing roller axial direction, and is preferably made from a material in which Br>0.5 T (tesla) in order to obtain a narrow width and high magnetic characteristics, and in most cases it is possible to use a rare earth magnet based on neon (such as Ne.Fe.B) or based on samarium (such as Sm.Co or Sm.Fe.N), or a plastic magnet or rubber magnet obtained by mixing one of these magnetic powders with one of the polymer compounds discussed above.

Figure 2:
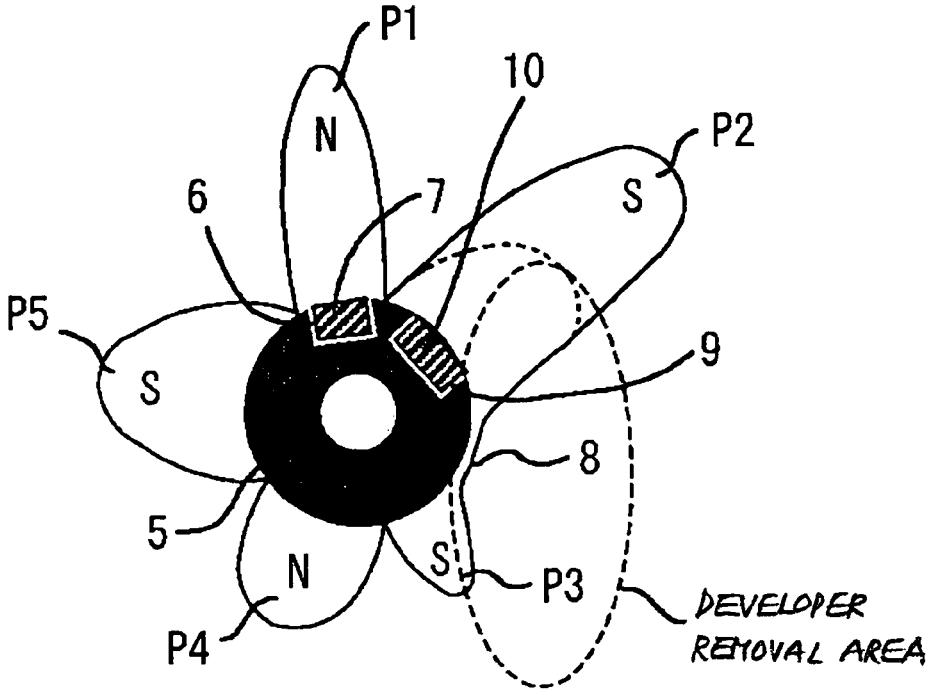
FIG. 2 is a diagram illustrating an example of the magnet roll of the developing roller pertaining to the present invention.

The magnet roll 5 shown in FIG. 2 is provided with five magnetic poles P1 to P5. P1 is the above-mentioned developing pole, while the magnetic poles P2 and P3 both have the same polarity (S in this example) and form a developer removal area 8. The magnetic poles P4 and P5 are conveyance poles, and are magnetized so that one is N and the other S.

It was described above how the problem of carrier deposition is likely to occur with a developing roller 2 structured in this way. It is a product of the balance between the electrical force from the latent image support and the magnetic force from the developing roller acting on the carrier. If the electrical force is strong, the carrier will be deposited on the latent image support.

A favorable way to reduce such carrier deposition is to increase the magnetic force of the magnetic pole P2 adjacent to the developing pole P1 on the downstream side in the developer conveyance direction. Specifically, if the magnetic force of the magnetic pole P2 is strong, any carrier that has moved to, or attempts to move to, the latent image support can be returned to the developing apparatus 1 side. However, if the magnetic force of the magnetic pole P2, and particularly the peak magnetic flux density on the developing sleeve 4, is over 140 mT, the force at which the developer is pulled to the developing roller 2 may be too strong, causing the developer to clog up between the case of the developing apparatus 1 and the developing roller 2. Also, when the magnetic force of the magnetic pole P2 is increased, even if this is accomplished by magnetization of the magnet roll 5, because of the NS balance of the entire magnet roll 5, the magnetic pole P2 cannot be made larger by itself without changing the other magnetic poles P3 to P5. Specifically, even if the magnetic force of the magnetic pole P2 is raised, the overall ratio of N and S poles of the magnet roll 5 is limited to 1:1.01, and cannot be raised over this. Thus, since the P2 pole is an S pole, if this magnetic pole is made larger, the magnetic force of P3 and P5, which are the other S poles of the magnet roll 5, will drop, which leads to problems with developer conveyance and so forth. Furthermore, there is a limit to the magnetic characteristics that can be obtained for the magnetic pole P2 with the magnet roll 5, and magnetic characteristics that are effective at reducing carrier deposition cannot be obtained.

Furthermore, the magnetic pole P2, unlike the developing pole P1, must have a wide magnetic flux density distribution. The reason is that experimentation has revealed that when a wide molded magnet (4 to 10 mm) is used for the magnetic pole P2, the carrier deposition margin increases over that when using a molded magnet with a width of about 2 to 3 mm, which is the same as that of the developing pole P1. Furthermore, with a configuration in which the developer removal area 8 is between the magnetic poles P2 and P3, the developing pole P1 and the developer removal area 8 will be too close together at less than 1.05 times the half value width of the magnetic pole P2, which complicates the layout of the developing apparatus 1. On the other hand, though, if the width is more than 3 times, the developing pole P1 and the developer removal area 8 will be too far apart, resulting in poor developer conveyance, so the half value width of the magnetic pole P2 is preferably from 1.05 to 3 times the half value width of the developing pole P1.

In view of this, in order to raise the magnetic characteristics of the magnetic pole P2 on the magnet roll 5 as indicated by the broken line in FIG. 2 to the position indicated by the solid line, a groove 9 is provided to the magnet roll 5, and a molded magnet 10 is installed in this groove 9 as a wide molded magnet with better magnetic characteristics. This molded magnet 10, just as with the developing pole P1, is a rare earth magnet or a plastic magnet or rubber magnet obtained by mixing a magnetic powder thereof with one of the polymer compounds discussed above. If a rare earth magnet is used for the magnetic pole P2 of the magnet roll 5, then even though there are more magnetic poles with the same polarity as the magnetic pole P2, and the overall ratio of N poles to S poles of the magnet roll 5 is at least 1:1.02 (such as a ratio of N poles to S poles of 1:1.04), the other poles will achieve their magnetic characteristics and it will be possible to obtain a magnetic waveform that is effective at increasing the carrier deposition margin. Even though it will be possible to produce small numbers of products in which the ratio of N poles to S poles is 1:1.04 by magnetizing the magnet roll 5 with a plastic magnet or rubber magnet alone, the poor N-S balance will make it very difficult to manufacture such products in quantity. If the molded magnet 10 is adhesively applied, then even if the overall ratio of N poles to S poles of the magnet roll is 1:1.04, a product with the same magnetic characteristics can be produced with ease.

Figure 3:
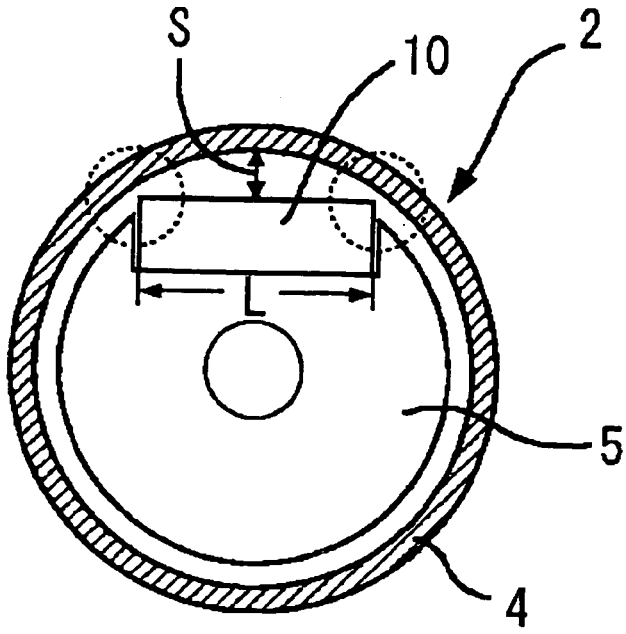
FIG. 3 is a diagram illustrating a developing roller when a wide molded magnet is installed.
Figure 4A:
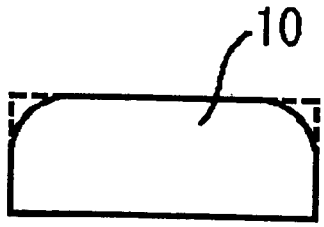
FIGS. 4A, 4B, and 4C are diagrams illustrating modification examples of the molded magnet.
Figure 4B:
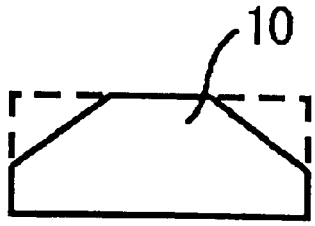
Figure 4C:
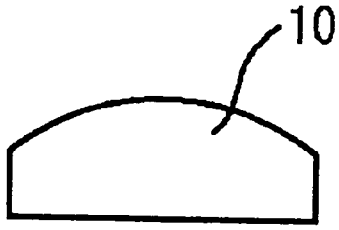

As discussed above, since this magnetic pole P2 needs to be wider than the developing pole P1, the width L of the molded magnet 10 itself is increased (so that L is from 4 to 10 mm, for example), as shown in FIG. 3. However, if a wide molded magnet 10 is installed in the magnet roll 5 so that the outside corners do not interfere with the developing sleeve 4, this will produce a relatively large gap S between the top of the molded magnet 10 and the developing sleeve 4, which prevents a strong magnetic force from being obtained. Consequently, the gap S is reduced by rounding or cutting off the top corners of the molded magnet 10 as shown in FIGS. 4A and 4B. Preferably, as shown in FIG. 4C, the upper surface of the molded magnet 10 is formed in a bow-shaped arc that substantially follows the curve of the developing sleeve 4. The result of this is that the above-mentioned gap is substantially kept to the minimum width, affording better magnetic characteristics and the desired magnetic pole width.

Figure 5A:
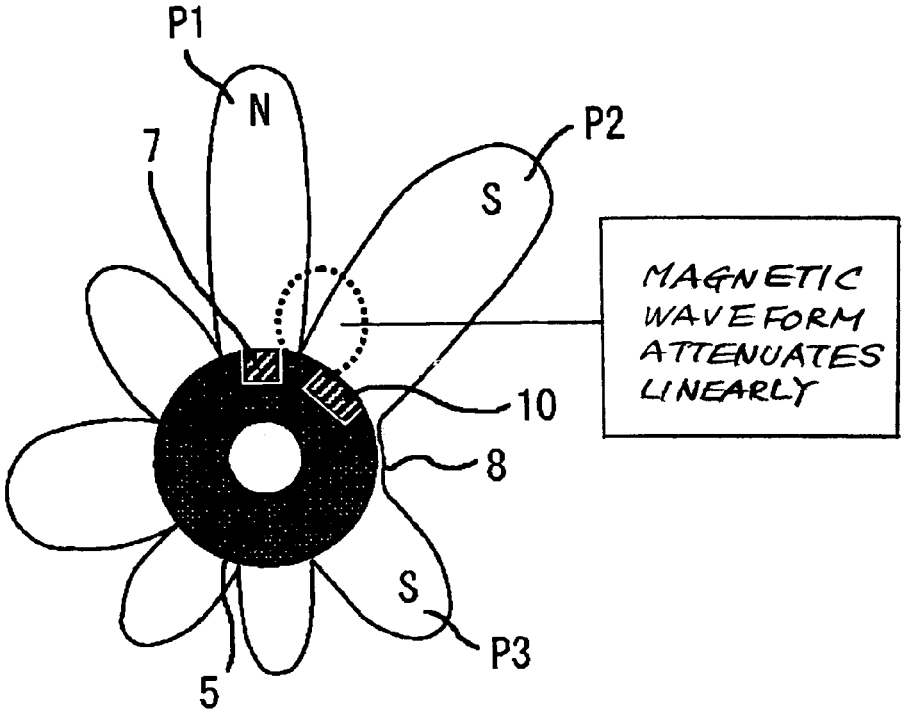
FIG. 5A is a diagram illustrating a magnet roll with a magnetic waveform of a magnetic pole P2 that varies linearly.
Figure 5B:
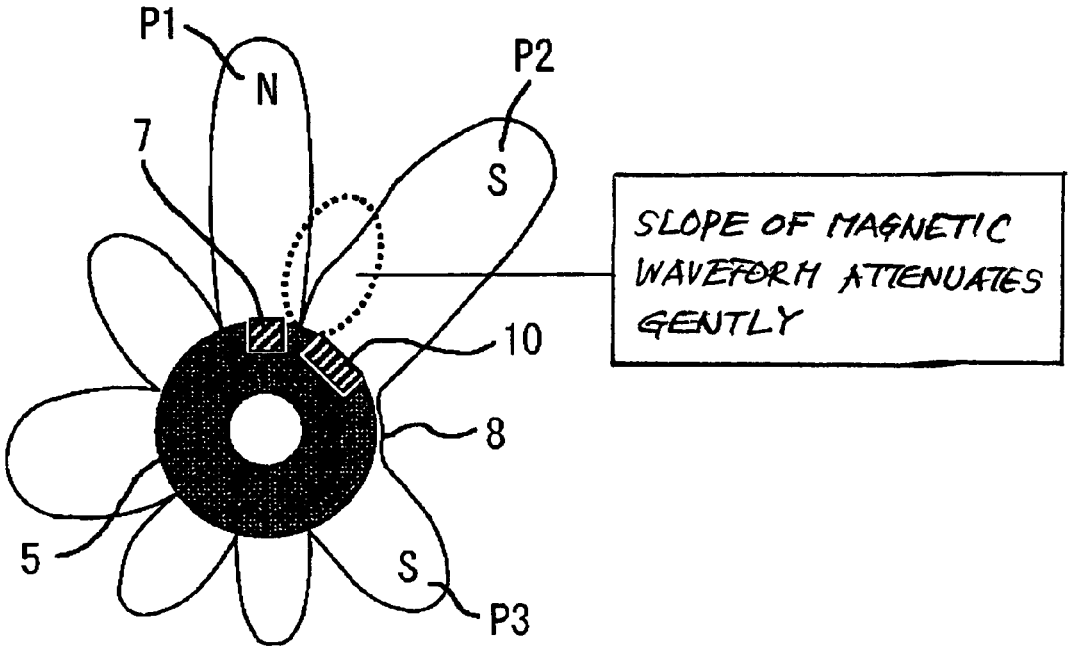
FIG. 5B is a diagram illustrating a magnet roll with a magnetic waveform of a magnetic pole P2 that varies gently.

Incidentally, it is known that when an increase in carrier deposition margin is desired, it is effective for there to be a high rate of change in the magnetic flux density of the portion where the magnetic characteristics of the magnetic pole P2 attenuate to the developing pole P1, and a waveform that changes linearly is more effective than a waveform with a gentle slope, such as the magnetic waveform of the magnetic pole P2 on the developing pole P1 side, which has an inflection point. Specifically, experimentation has revealed that the linear attenuation shown in FIG. 5A is more effective at preventing carrier deposition than is the gentle attenuation shown in FIG. 5B. To obtain the linear attenuation shown in FIG. 5A, it is effective for the half value width of the magnetic pole P2 to be greater than the half value width of the developing pole P1. Since the magnetic waveform of the magnetic pole P2 combines the magnetic force of the magnet roll 5 and the molded magnet 10, it is believed that the magnetic orientation of the magnet roll 5 is affected by whether the magnetic waveform is linear or gentle.

However, in the portion where the magnetic pole P2 attenuates to the magnetic pole P3 side, there is no need for the magnetic waveform to change linearly. Particularly if the magnetic waveform from the magnetic pole P2 to the magnetic pole P3 is the developer removal area, the magnetic flux density region of the magnetic pole P2 will be wider when the magnetic waveform of the magnetic pole P2 on the magnetic pole P3 side changes linearly and sharply than when it changes gently, and the overall N-S balance of the roll will make it difficult to achieve the magnetic characteristics of the other poles with the same polarity as the magnetic pole P2. In particular, the developer removal area 8 tends to invert to opposite polarity between the magnetic pole P2 and the magnetic pole P3, and when this region changes to the opposite polarity, the developer becomes difficult to remove, which adversely affects image characteristics.

Figure 6:
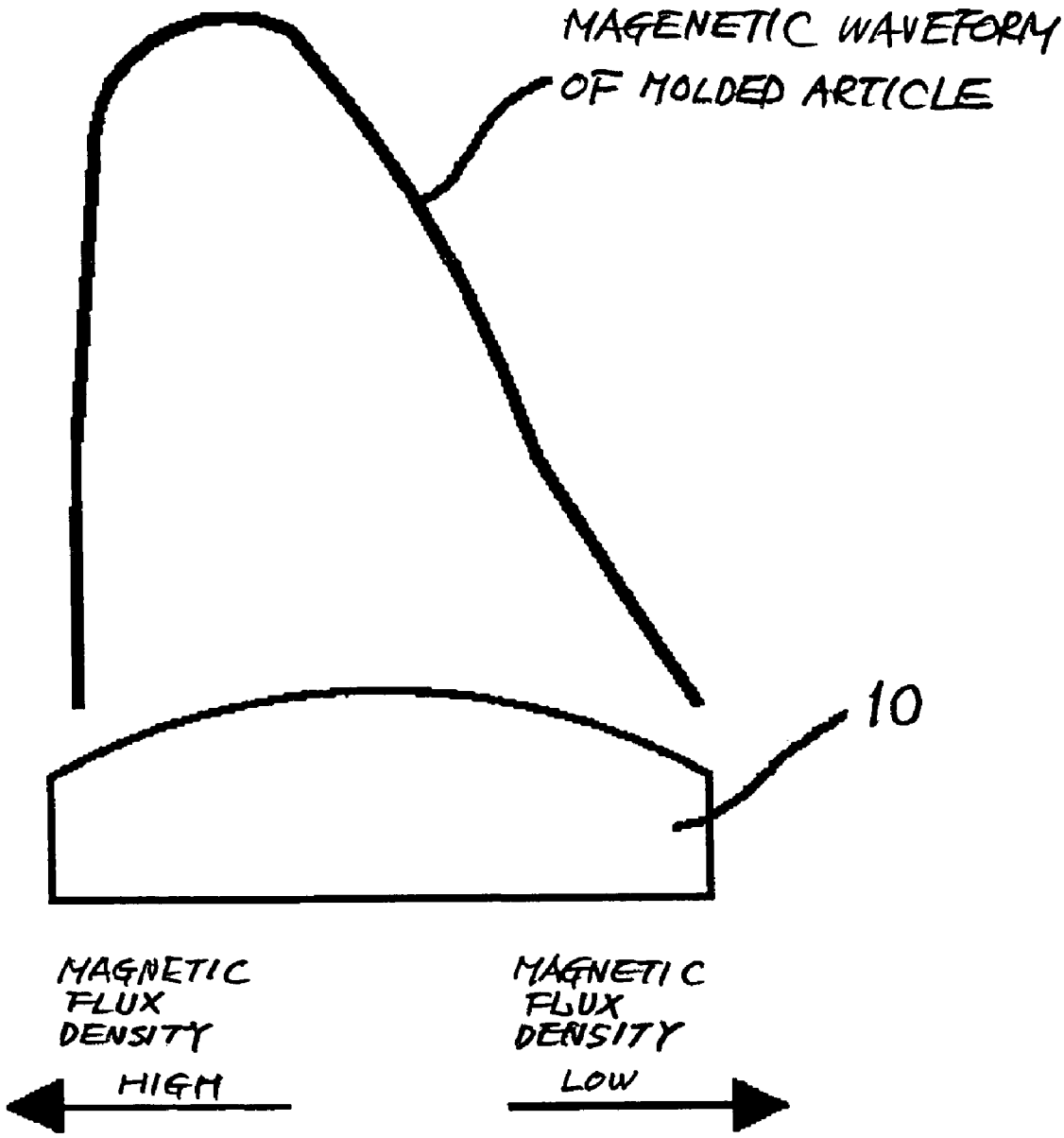
FIG. 6 is a diagram illustrating a preferred magnetic waveform of the molded magnet of the magnetic pole P2.

In view of this, in this example, the magnetic characteristics in the minor axis direction of the molded magnet 10 shown in FIG. 6, that is, the developer conveyance direction, is changed, the magnetic characteristics on the developing pole P1 side, where the magnetic characteristics need to be changed sharply, are raised, and the magnetic characteristics on the magnetic pole P3 side, where a more gentle change is desired, are lowered, which results in an even better N-S balance and makes it possible to obtain a magnet roll that is effective at obtaining good image characteristics. Since the overall N-S balance of the magnet roll is better, productivity is also increased.

Figure 7A:
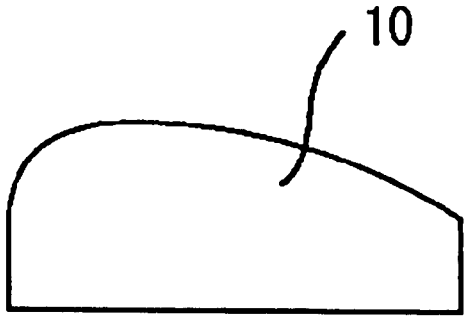
FIG. 7A is a front view of a molded magnet that yields a favorable magnetic waveform.
Figure 7B:
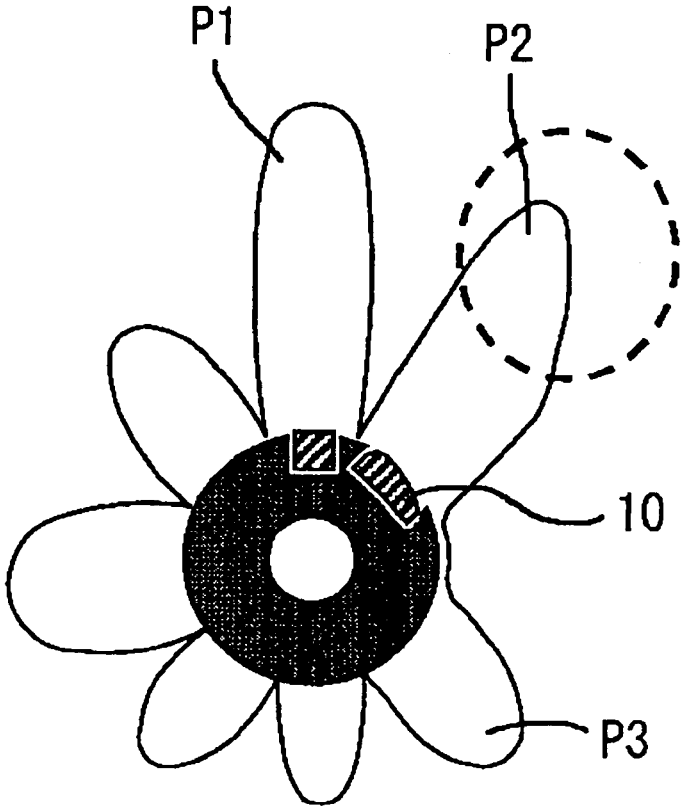
FIG. 7B is a diagram illustrating the magnetic waveform of a magnet roll obtained by using this molded magnet.

With the magnet roll 5 having such magnetic characteristics, even with a molded magnet 10 of uniform magnetic characteristics, if, for example, the rounded shape on the developing pole P1 side is made the same as the rounded shape on the inside of the developing sleeve 4, and the rounded shape on the magnetic pole P3 side is made flatter, as shown in FIG. 7A, then as shown in FIG. 7B, the space between the developing sleeve 4 and the molded magnet 10 will be narrower on the developing pole P1 side, and the space between the developing sleeve 4 and the molded magnet 10 will be wider on the magnetic pole P3 side, resulting in lower magnetic characteristics.

Figure 8A:
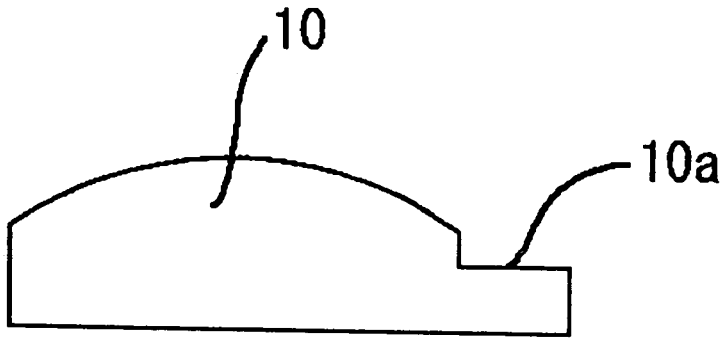
FIG. 8A is a front view of a molded magnet that yields a favorable magnetic waveform.
Figure 8B:
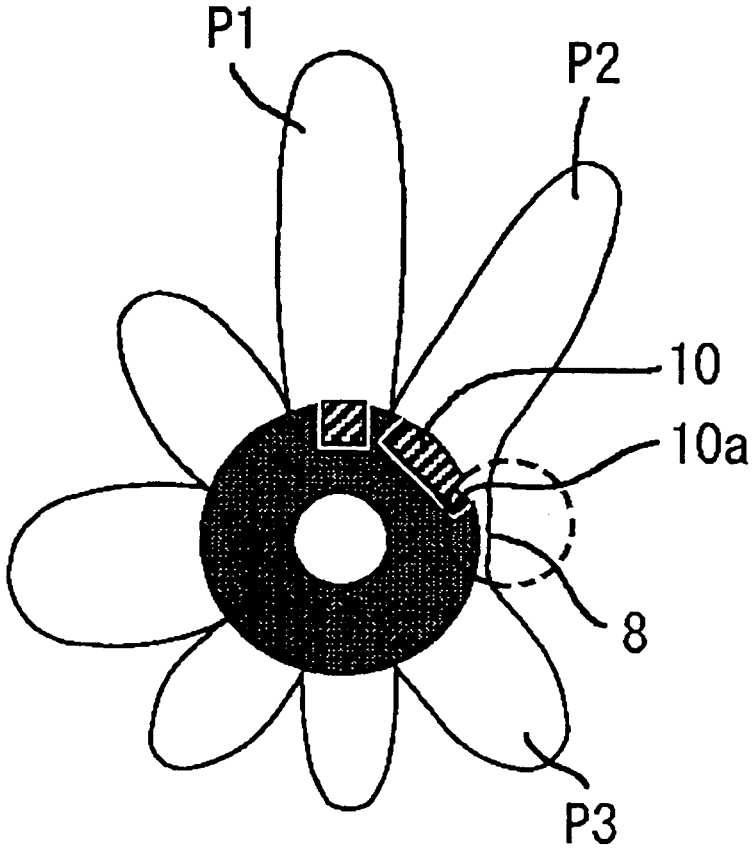
FIG. 8B is a diagram illustrating the magnetic waveform of a magnet roll obtained by using this molded magnet.

Also, as shown in FIG. 5A, if the molded magnet 10 of high magnetic force is disposed at the magnetic pole P2 on the magnet roll 5 with a magnetic waveform such that the magnetic pole P3 adjacent to the magnetic pole P2 has the same polarity, and the developer removal area is between the magnetic poles P2 and P3, the magnetic pole P2 side of the developer removal area 8 will tend to invert. In view of this, as shown in FIG. 8A, if a flat portion 10*a* is provided on the developer removal area 8 side of the molded magnet 10 of the magnetic pole P2, then as shown in FIG. 8B, the magnetic waveform near the developer removal area 8 of the magnetic pole P2 will change gently, making the developer removal area 8 less apt to invert its polarity and making it possible to obtain a magnet roll 5 with even better N-S balance.

To obtain the molded magnet 10 used in the present invention, either a sintered magnet composed of just magnet powder, or a molded plastic magnet obtained by molding a plastic magnet composed of a magnet powder and a polymer compound can be used, but since the magnetic characteristics will be extremely high when a rare earth magnet powder is used, for example, there is no need to use a sintered magnet. Also, a rare earth magnet powder is extremely high in cost, and the cost is high with a sintered magnet. In view of this, the use of a molded plastic magnet is preferred.

Figure 9:
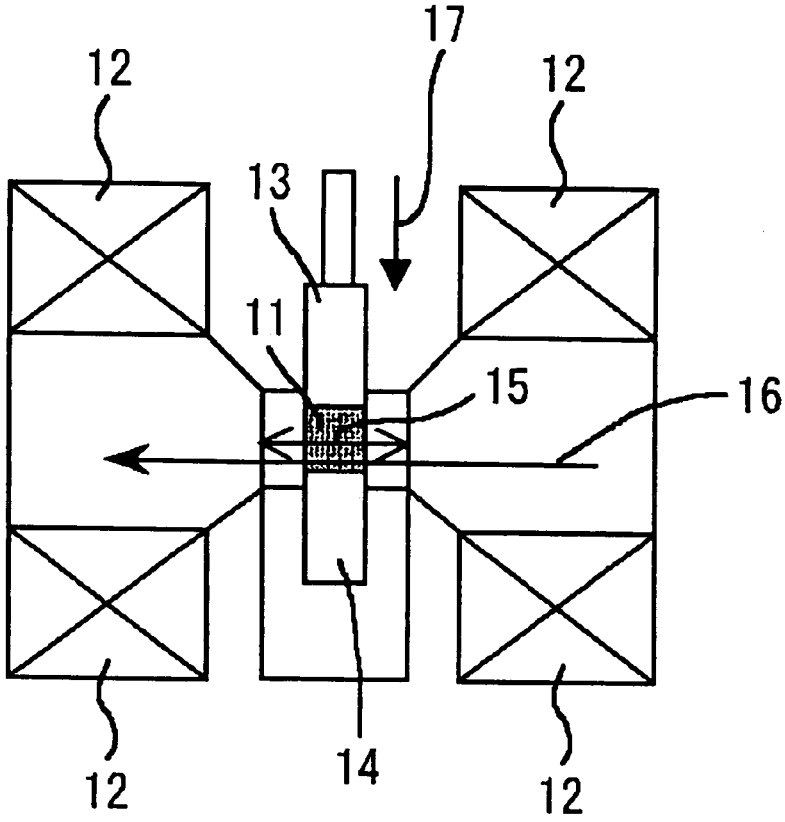
FIG. 9 is a simplified structural diagram illustrating a compression molding method for obtaining a molded magnet.

Examples of methods for obtaining a molded plastic magnet include standard injection molding, extrusion molding, and compression molding methods. To obtain a molded magnet with high magnetic force, molding by one of the above methods must be performed simultaneously with the orientation of the magnet powder by the application of a magnetic field. With injection molding, the size of the mold is fixed, which affords high precision molding, but since the material has to flow into the mold, a high proportion of resin has to be contained, which means that the proportional content of the magnet powder cannot be raised, making it difficult to obtain a magnet with high magnetic force. With extrusion molding, productivity is excellent, but dimensional precision is poor. Also, just as with injection molding, it is difficult to increase the proportional content of magnet powder, making it difficult to obtain a magnet with high magnetic force. Therefore, it is preferable for the molded magnet 10 to be obtained by compression molding. With compression molding, as shown in FIG. 9, the orientation of the molded article will be higher if a magnetic field is applied perpendicular to the compression molding direction, and this is an effective way to obtain a molded magnet with high magnetic force (lateral magnetic field molding method). In FIG. 9, 11 is a magnet molding component, 12 is an electromagnet, 13 is an upper punch, 14 is a lower punch, 15 is a gap, 16 is the direction of magnetic field application, and 17 is the pressing direction. After the mold is filled with the material, it is fixed over the lower punch 14, and current is passed through the electromagnet 12 to generate a magnetic field in the direction of the arrow 16, while pressure is applied with the upper punch 13 in the direction of the arrow 17, which produces a molded magnet with high magnetic force.

Figure 10:
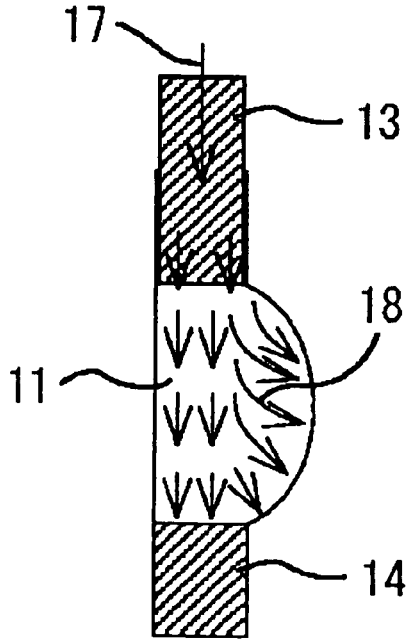
FIG. 10 is a diagram illustrating the direction in which pressure is applied to the molded article during compression molding.

Also, it is possible to utilize the pressing force during compression molding to achieve higher magnetic characteristics on the developing pole P1 side (where it is necessary to change the magnetic characteristics sharply) and lower magnetic characteristics on the magnetic pole P3 side (where a gentle change is desirable). When the molded magnet is obtained by compression molding, pressure is applied as shown in FIG. 10 inside the mold (the magnet molding component). That is, when pressure is applied by the upper punch 13 in the direction of the arrow 17, the pressure inside the mold 11 is dispersed in the direction indicated by the arrow 18, so the pressure is highest and the compression density of the material is greatest at the pressing surface, the result being that the magnetic characteristics are higher there than at the bottom. In view of this, the pressing surface side where the punch 13 comes into contact with the magnetic powder is disposed toward the developing pole P1 side, which allows a roller with superior N-S balance to be obtained with ease.

The overall N-S balance of the magnet roll is better with a roll in which the molded magnets are disposed as above. It is also possible to provide a developing apparatus 1 that affords high-quality developing performance, with a high carrier deposition margin for the magnet roll 5 on which there is a magnetic pole that is wide, has a high peak, and has a magnetic flux density that changes linearly, downstream from the developing pole.

Figure 11:
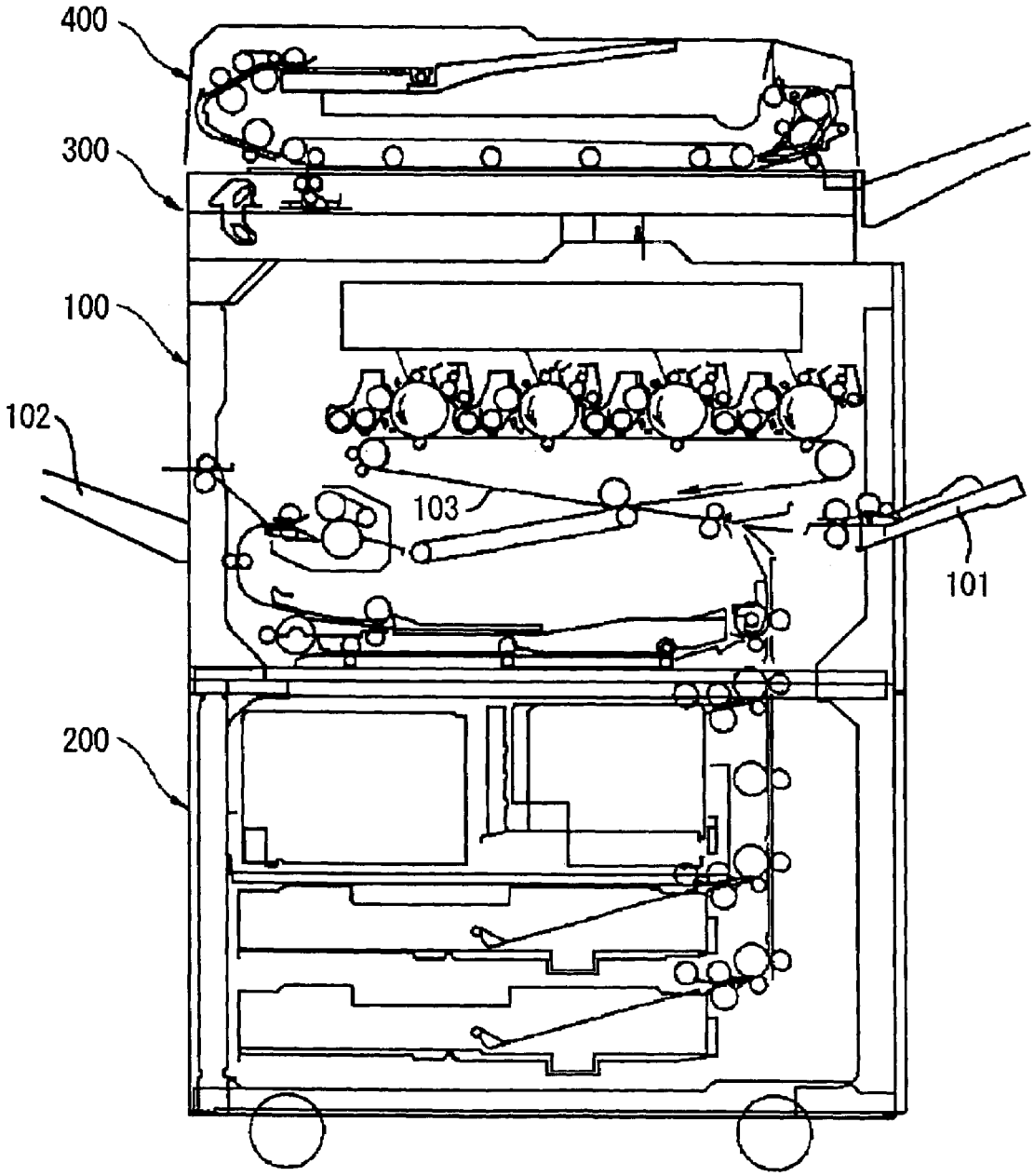
FIG. 11 is a simplified diagram illustrating an image formation apparatus that makes use of the developing apparatus pertaining to the present invention.

The developing apparatus 1 configured as above is used in the color image formation apparatus shown in FIG. 11, for example. The image formation apparatus shown in FIG. 11 comprises an image formation apparatus main body 100 that performs image formation, a paper feed apparatus 200 that is disposed under the image formation apparatus main body 100 and feeds transfer paper (not shown) as the recording medium to the image formation apparatus main body 100, a scanner 300 that is attached over the image formation apparatus main body 100 and reads the images on a document, and an automatic document feed apparatus (ADF) 400 that is provided on top of the scanner 300. The image formation apparatus main body 100 is provided with a manual bypass tray 101 for feeding transfer paper manually, and a discharge tray 102 for receiving the printed transfer paper discharged from the 100.

The image formation apparatus 100 shown in FIG. 11 has first to fourth image supports configured as photosensitive drums. Yellow toner images, magenta toner images, cyan toner images, and black toner images are formed on these four image supports, respectively. These toner images are transferred and superposed onto an intermediate transfer belt across from the first to fourth image supports, and the images are then transferred all at once to the transfer paper, and when the developing apparatus 1 is used to develop these toner images, the resulting image has high quality and a high carrier deposition margin.

Figure 12:
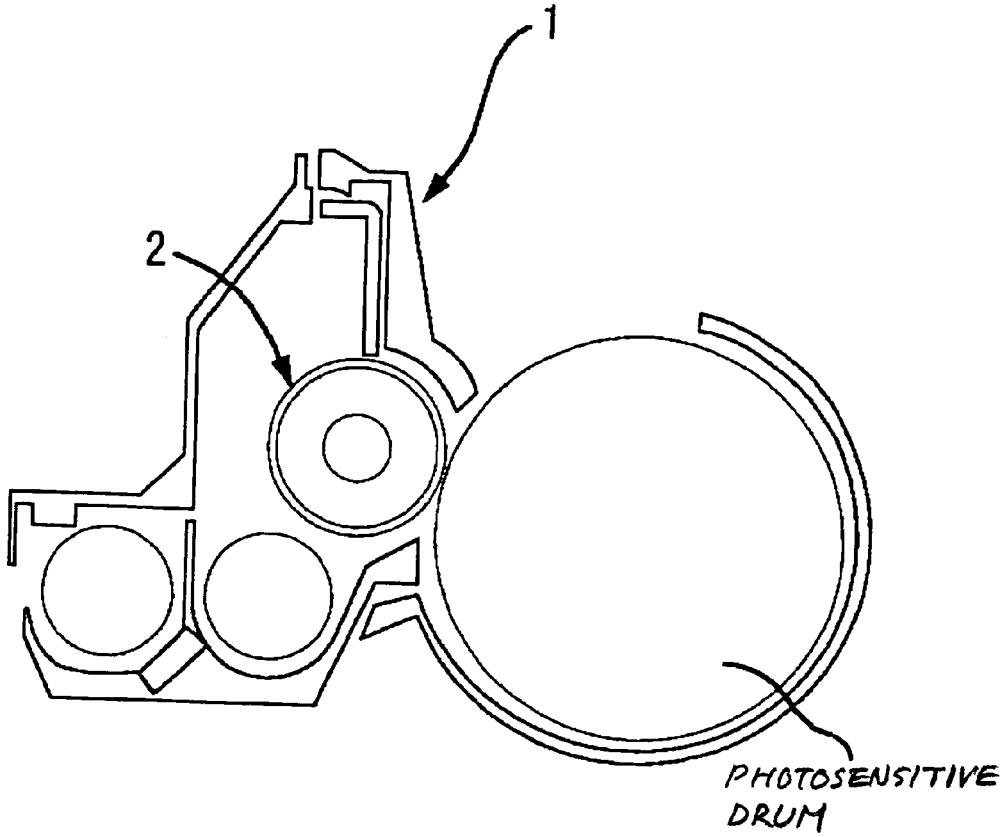
FIG. 12 is a simplified diagram of a process cartridge that makes use of the developing apparatus pertaining to the present invention.
Figure 13:
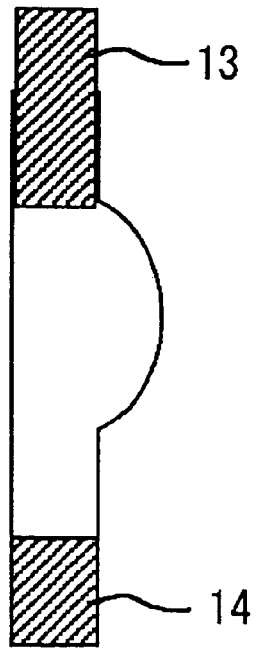
FIG. 13 is a diagram illustrating the mold in an example of the present invention.

Also, the developing apparatus 1 can be used in a process cartridge in which the photosensitive drums and the developing apparatus 1 are made into a unit as shown in FIG. 12, in which case the resulting image has high quality, with few defects in the image.

Specific examples of this example will now be described.

Molded Magnet 7 weight parts of microparticles with the following composition and blend ratios were added to 93 weight parts of MFP-12, an Nd—Fe—B-based anisotropic magnetic powder made by Aichi. The components were dispersed under stirring to produce a compound material.

The MFP-12 used here had an average particle size of 150 μm, and the thermoplastic resin had a softening point of 75° C. and an average particle size of 7.3 μm. thermoplastic resin

| | |
|---|---|
| thermoplastic resin | |
| (1) polyester resin | 79 weight parts |
| (2) styrene-acrylic resin | 7 weight parts |
| pigment | |
| carbon black | 7.6 weight parts |
| antistatic agent | |
| zirconium salicylate | 0.9 weight part |
| parting agent | |
| blend of carnauba wax and rice wax | 4.3 weight parts |
| fluidity imparter | |
| hydrophobic silica | 1.2 weight parts |

The various molds listed in FIG. 14 were each filled with the above magnetic powder compound, and a pressing force of 5.5 tons/cm$^2$ was applied while a magnetic field of 18,000 Oe was applied, which yielded the developing pole P1 molded magnets and the molded magnets of Specific Examples (1), (2), and (3). The magnetic field direction here was perpendicular to the pressing direction, and lateral magnetic field molding was performed as shown in FIG. 9.

Each of the above molded magnets was placed in a flat baking jig after molding, and baked (annealed) for 10 minutes at 100° C. to increase the magnet strength and correct any warpage that occurred in molding. After baking, pulse magnetization was performed with a hollow-core coil, which produced the molded magnet 7 or 10. The molded magnets of Specific Examples (1), (2), and (3) molded as above all had a BHmax value (indicates the strength per unit of volume of a magnet) of at least 13 MGOe.

FIG. 14 is a table of the properties of the mold and completed article of the molded magnets.

The BHmax value of the magnet roll obtained above was about 2 MGOe. A groove was formed in the developing pole P1 and magnetic pole P2 here. The developing pole P1 groove was 3.0 mm deep, 2.5 mm wide, and 306.1 mm long, while a groove 2.3 mm deep, 10.0 mm wide, and 306.1 mm long was formed for the magnetic pole P2.

The poles of the plastic magnet roll produced above were magnetized by yoke magnetization, after which the molded magnets were disposed in the grooves of the developing pole P1 and the magnetic pole P2 and fixed with an instantaneous adhesive. As comparative examples, a plastic magnet roll 5 with no groove in the magnetic pole P2 was formed, and a molded magnet was disposed only in the groove in the developing pole P1 and fixed with an instantaneous adhesive to produce magnet roll Comparative Example 1, and a material obtained by mixing anisotropic Nd—Fe—B and 12PA was injection molded in cuboid form and in the size shown in FIG. 14 in a magnetic field of 10 KOe, and the resulting molded article was disposed in the magnetic pole P2 groove and fixed with an instantaneous adhesive to produce magnet roll Comparative Example 2. These magnet rolls were evaluated for magnetic characteristics and carrier deposition margin, the results of which are given in FIG. 15.

It is undesirable for the magnetic flux density to be higher for the P1 pole than for the P2 pole, and for the half value width to be greater for the P1 pole than for the P2 pole, because in addition to the problem with carrier deposition encountered in Comparative Example 3, developer removal will be unsatisfactory with a developing apparatus configured as above in this case (in which the developer is removed between the magnetic pole adjacent to the developing pole on the downstream side and the magnetic pole adjacent further downstream). The relatively narrow half value width of the magnetic pole P2 results in the distance to the magnetic pole P3 being too far, causing a decrease in the repellency force between the magnetic pole P2 and the magnetic pole P3 and hampering developer removal.

The present invention offers the following advantages.

(1) The magnetic pole adjacent to the developing pole of the magnet roll downstream in the developer conveyance direction has a peak magnetic flux density on the developing sleeve equal to or greater than that of the developing pole, and has a half value width, which is the width of the magnetic pole at which a magnetic flux density of one-half the peak magnetic flux density is exhibited, is greater than that of the developing pole. Therefore, the carrier is less apt to scatter away from the developing roller, and even if it does scatter, it can be pulled back, so there is less carrier deposition onto the image support.

(2) The magnetic pole adjacent to the developing pole downstream in the developer conveyance direction has a peak magnetic flux density of from 100 mT to 140 mT, which is effective at preventing carrier deposition.

(3) The magnetic pole adjacent to the developing pole downstream in the developer conveyance direction has a half value width that is at least 1.05 times and no more than 3 times the half value width of the developing pole, which is effective at preventing carrier deposition.

(4) The magnetic pole adjacent to the developing pole downstream in the developer conveyance direction is composed of a molded magnet whose magnetic force per unit of volume is greater than that of the magnet roll, and the molded magnet is disposed in a groove provided to the magnet roll. Therefore, the peak magnetic flux density of the magnetic pole downstream from the developing pole can be increased, and a developing roller can be manufactured even with magnetic field characteristics in which there is a N-S imbalance in the magnet roll.

(5) The magnet roll has a total number of magnetic poles that is an odd number of at least five, the two magnetic poles forming a developer removal area for removing the developer on the developing sleeve from the developing sleeve are of the same polarity, and the magnetic pole adjacent to the developing pole downstream in the developer conveyance direction has the same polarity as whichever of the N and S poles is in the majority. Therefore, better developer removal is possible.

(6) The magnetic pole adjacent to the developing pole downstream in the developer conveyance direction has the same polarity as the adjacent pole downstream therefrom, and the developer removal area is provided between these two magnetic poles. Therefore, the magnetic pole downstream from the developing pole both prevents carrier deposition and affords good developer removal.

(7) When the width of the molded magnet of the developing pole is from 2 to 3 mm, the width of the molded magnet of the magnetic pole adjacent downstream in the developer conveyance direction is from 4 to 10 mm. Therefore, the magnetic pole downstream from the developing pole functions both for preventing carrier deposition and for developer removal.

(8) The magnetic pole adjacent to the developing pole composed of a molded magnet downstream in the developer conveyance direction has a convex curved shape on the developing sleeve side, and the magnetic characteristics are different in the magnet roll circumferential direction, which allows the magnetic characteristics to be improved in just the required places within a magnetic pole, and makes it relatively easy to obtain a magnet roll with good image characteristics and a high degree of carrier deposition margin, with a better N-S balance.

(9) The molded magnet has a convex curved shape on the developing sleeve side, and is formed in left-right asymmetry around a radial line of the magnet roll passing through the center in the magnet roll circumferential direction, which allows the magnetic characteristics to be improved in just the required places within a magnetic pole, and makes it relatively easy to obtain a magnet roll with good image characteristics and a high degree of carrier deposition margin, with a better N-S balance.

(10) The molded magnet has a convex curved shape on the developing sleeve side, and has a flat component that connects to one side of this convex curved shape and extends in the magnet roll circumferential direction. Therefore, there is no polarity inversion of the developer removal area, and it is relatively easy to obtain a magnet roll with good image characteristics and a high degree of carrier deposition margin, with a better N-S balance.

(11) The molded magnet is formed by compression molding in a magnetic field, and is disposed on the magnet roll so that the pressing side during compression molding is across from the developing pole. Therefore, it is relatively easy to obtain a magnet roll with good image characteristics and a high degree of carrier deposition margin, with a better N-S balance.

(12) The developing pole has a peak magnetic flux density on the sleeve of from 100 mT to 122 mT, and has a half value width of 25° or less, which reduces trailing edge loss and carrier deposition.

(13) Since the developing apparatus is equipped with the developing roller according to any of (1) to (12) above, it is possible to obtain a developing apparatus with good image characteristics and a high degree of carrier deposition margin.

(14) Since the process cartridge is equipped with the developing apparatus according to (14) above, it is possible to obtain a process cartridge with excellent image characteristics.

(15) Since the image formation apparatus is equipped with the developing apparatus according to (14) above, it is possible to obtain an image formation apparatus with excellent image characteristics.

Various modifications will become possible for those skilled in the art after receiving the teachings of the present disclosure without departing from the scope thereof.

What is claimed is:

1. A developing roller, comprising:

a developing sleeve including a nonmagnetic material; and a magnet roll provided inside said developing sleeve and formed by dispersing a magnetic powder in a polymer compound, a portion of the magnet roll corresponding to a developing pole of the magnet roll being equipped with a main-pole molded magnet whose magnetic force per unit of volume is greater than that of said magnet roll, wherein a magnetic pole adjacent to the developing pole of the magnet roll downstream in the developer conveyance direction has a peak magnetic flux density on the developing sleeve greater than that of the developing pole, and has a half value width, which is the width of the magnetic pole at which a magnetic flux density of one-half the peak magnetic flux density is exhibited, greater than that of the developing pole.

2. The developing roller according to claim 1, wherein the magnetic pole adjacent to the developing pole downstream in the developer conveyance direction has a peak magnetic flux density of from 100 mT to 140 mT.

3. The developing roller according to claim 2, wherein the developing pole has a peak magnetic flux density on the sleeve of from 100 mT to 122 mT, and has a half value width of 25° or less.

4. The developing roller according to claim 1, wherein the magnetic pole adjacent to the developing pole downstream in the developer conveyance direction has a half value width that is at least 1.05 times and no more than 3 times the half value width of the developing pole.

5. The developing roller according to claim 4, wherein, when the width of the molded magnet of the developing pole is from 2 to 3 mm, the width of the molded magnet of the magnetic pole adjacent downstream in the developer conveyance direction is from 4 to 10 mm.

6. The developing roller according to claim 4, wherein the molded magnet has a convex curved shape on the developing sleeve side, and the magnetic characteristics are different in the magnet roll circumferential direction.

7. The developing roller according to claim 4, wherein the molded magnet has a convex curved shape on the developing sleeve side, and is formed in left-right asymmetry around a radial line of the magnet roll passing through the center in the magnet roll circumferential direction.

8. The developing roller according to claim 4, wherein the molded magnet has a convex curved shape on the developing sleeve side, and has a flat component that connects to one side of this convex curved shape and extends in the magnet roll circumferential direction.

9. The developing roller according to claim 4, wherein the molded magnet is formed by compression molding in a magnetic field, and is disposed on the magnet roll so that the pressing side during compression molding is across from the developing pole.

10. The developing roller according to claim 1, wherein the magnetic pole adjacent to the developing pole downstream in the developer conveyance direction is composed of a molded magnet whose magnetic force per unit of volume is greater than that of the magnet roll, and said molded magnet is disposed in a groove provided to the magnet roll.

11. The developing roller according to claim 1, wherein the magnet roll has a total number of magnetic poles that is an odd number of at least five, the two magnetic poles forming a developer removal area for removing the developer on the developing sleeve from said developing sleeve are of the same polarity, and the magnetic pole adjacent to the developing pole downstream in the developer conveyance direction has the same polarity as whichever of the N and S poles is in the majority.

12. The developing roller according to claim 11, wherein the magnetic pole adjacent to the developing pole downstream in the developer conveyance direction has the same polarity as the adjacent pole downstream therefrom, and the developer removal area is provided between these two magnetic poles.

13. The developing roller according to claim 11, wherein, when the width of the molded magnet of the developing pole is from 2 to 3 mm, the width of the molded magnet of the magnetic pole adjacent downstream in the developer conveyance direction is from 4 to 10 mm.

14. A developing apparatus equipped with a developing roller for developing an electrostatic latent image formed on a latent image support, said developing roller comprising:

a developing sleeve including a nonmagnetic material; and a magnet roll provided inside said developing sleeve and formed by dispersing a magnetic powder in a polymer compound, a portion of the magnet roll corresponding to a developing pole of the magnet roll being equipped with a main-pole molded magnet whose magnetic force per unit of volume is greater than that of said magnet roll, wherein a magnetic pole adjacent to the developing pole of the magnet roll downstream in the developer conveyance direction has a peak magnetic flux density on the developing sleeve greater than that of the developing pole, and has a half value width, which is the width of the magnetic pole at which a magnetic flux density of one-half the peak magnetic flux density is exhibited, greater than that of the developing pole.

15. A process cartridge equipped with a developing apparatus, said developing apparatus being equipped with a developing roller for developing an electrostatic latent image formed on a latent image support, said developing roller comprising:

a developing sleeve including a nonmagnetic material; and a magnet roll provided inside said developing sleeve and formed by dispersing a magnetic powder in a polymer compound, a portion of the magnet roll corresponding to a developing pole of the magnet roll being equipped with a main-pole molded magnet whose magnetic force per unit of volume is greater than that of said magnet roll, wherein a magnetic pole adjacent to the developing pole of the magnet roll downstream in the developer conveyance direction has a peak magnetic flux density on the developing sleeve greater than that of the developing pole, and has a half value width, which is the width of the magnetic pole at which a magnetic flux density of one-half the peak magnetic flux density is exhibited, greater than that of the developing pole.

16. An image formation apparatus equipped with a developing apparatus, said developing apparatus being equipped with a developing roller for developing an electrostatic latent image formed on a latent image support, said developing roller comprising:

a developing sleeve including a nonmagnetic material; and a magnet roll provided inside said developing sleeve and formed by dispersing a magnetic powder in a polymer compound, a portion of the magnet roll corresponding to a developing pole of the magnet roll being equipped with a main-pole molded magnet whose magnetic force per unit of volume is greater than that of said magnet roll, wherein a magnetic pole adjacent to the developing pole of the magnet roll downstream in the developer conveyance direction has a peak magnetic flux density on the developing sleeve greater than that of the developing pole, and has a half value width, which is the width of the magnetic pole at which a magnetic flux density of one-half the peak magnetic flux density is exhibited, greater than that of the developing pole.

* * * * *